US006170979B1

(12) United States Patent
Smeaton

(10) Patent No.: US 6,170,979 B1
(45) **Date of Patent: *Jan. 9, 2001**

(54) FLUID INJECTION AND MONITORING APPARATUS

(76) Inventor: Ian Smeaton, 65 Thirlmere, Ivy Farm Estate, Macclesfield, Cheshire, England SK11 7JY (GB)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/085,348

(22) Filed: May 27, 1998

(51) Int. Cl.[7] ..... B01F 5/04
(52) U.S. Cl. ..... 366/173.1; 366/174.1
(58) Field of Search ..... 366/162.1, 167.1, 366/173.1, 173.2, 174.1, 181.5, 181.6

(56) References Cited

U.S. PATENT DOCUMENTS

| | | | |
|---|---|---|---|
| 4,114,195 | * | 9/1978 | Dirksing et al. . |
| 4,564,298 | * | 1/1986 | Gritters et al. . |
| 4,573,803 | | 3/1986 | Gritters . |
| 4,586,825 | * | 5/1986 | Hayatdavoudi . |
| 4,838,703 | * | 6/1989 | McMaster et al. . |
| 4,976,547 | * | 12/1990 | Hisanaga et al. . |
| 5,388,906 | | 2/1995 | Rao . |
| 5,478,150 | * | 12/1995 | Keller et al. . |
| 5,518,700 | * | 5/1996 | Ayoub et al. . |
| 5,556,200 | * | 9/1996 | Ekholm et al. . |
| 5,816,700 | * | 10/1998 | Starke, Sr. et al. . |

FOREIGN PATENT DOCUMENTS

| | | | |
|---|---|---|---|
| 1457272 | * | 2/1969 | (DE) . |
| 0761298 | | 3/1997 | (EP) . |
| 2006033 | | 5/1979 | (GB) . |
| 2015360 | * | 9/1979 | (GB) . |
| 1601403 | | 10/1981 | (GB) . |
| 2319734 | * | 6/1998 | (GB) . |
| 9512452 | | 5/1995 | (WO) . |

* cited by examiner

*Primary Examiner*—Charles E. Cooley
(74) *Attorney, Agent, or Firm*—Edwin D. Schindler

(57) ABSTRACT

A fluid injection and monitoring apparatus for the introduction of one or more fluid additives to a gaseous or liquid stream, and for monitoring the stream, such that the additives will be able to be introduced without providing a point of weakness in the pipeline, includes at least two pipe members extending radially into a pipeline, with each of the pipe members having a conduit for flow of a fluid additive material radially inward along the pipe members. A plurality of discharge orifices are provided in each of the pipe members on a downstream side thereof, with the plurality of discharge orifices being arranged in a spaced array along a respective pipe member for discharge of one or more additives downstream into said gaseous or liquid stream.

18 Claims, 4 Drawing Sheets

FLUID INJECTION AND MONITORING APPARATUS

BACKGROUND OF THE INVENTION

1. Technical Field of the Invention

This invention relates to fluid injection and monitoring apparatus for the introduction of one or more fluid additives to a gaseous or liquid stream and for monitoring the stream.

2. Description of the Prior Art

In for example the oil extraction industry, it is known practice to inject additives into a gas or liquid stream in a pipe line to accomplish "conditioning" of the oil, adding various chemicals to enhance desired properties or counteract undesired properties. At present, the usual practice is to inject the additive through a branch pipe opening radially or tangentially into the main pipe line. This however creates a weakness in the pipe line string which is eroded by the high-fluid flow rates in the main pipe line, leading to possible catastrophic failure. In an alternative, a branch pipe line terminates in a probe or projecting tube fed by a branch pipe, the probe extending some distance into the main pipe line flow passage to discharge the additive into the main flow. An example of such an arrangement is shown in GB 1,601,403, where a radially extending probe introduces an additive into a fluid stream, upstream with respect to a static mixer. Such a probe is again vulnerable to erosion leading to failure.

It is also known from GB 2015360-A to provide an injector in mixing a apparatus, comprising a diametrically extending tube extending across a flow passage, with discharge orifices directed to the downstream side of the tube, to introduce the additive in the lee of the tube. The discharge orifices are arranged in two sets, each set discharging into one of a pair of split fluid streams, and this arrangement is disclosed only as part of a static mixing apparatus.

It is also desirable to be able to monitor the condition of the fluid stream to, for example, control the introduction of additives in response to stream conditions.

SUMMARY OF THE INVENTION

An object of this invention is to provide a device for injection of one or more additives into a fluid stream particularly, but not exclusively in oil and/or gas pipe lines which will enable such additives to be introduced without providing a point of weakness in the pipe line.

In accordance with the invention an injection apparatus for introduction of one or more additives to a gaseous or liquid stream comprises at least one diametrically extending pipe member including a conduit and discharge orifices for discharge of the, or each, additive into said stream.

The diametrically extending pipe members are preferably coplanar, and arranged as radial spokes across an orifice which matches the main pipe cross-section, provided in a circular wheel-like arrangement in a plate-like member.

Such wheel-like or plate-like member can in use be inserted between the junction flanges of adjacent pipe-sections, the flanges being jacked apart for insertion of the member, and then clamped to provide a seal about the member.

The device may have a separate inlet duct, connectable to a respective feed line, for each of the additives to be introduced at that point. Each additive may be supplied via a respective radial or diametrical extending pipe member, so that a cruciform arrangement of pipe members may either provide two diametrical manifolds, one diametrical and two radial manifolds, or four radial manifolds, for two, three, or four additives respectively.

The device may also provide for monitoring of the condition of the fluid stream, by provision of appropriate sensors, such as a temperature probe, on or in the device.

The obstruction provided by the structure of diametrical or radial pipe members will create turbulence on its downstream side, which will aid mixing of the additives with the main fluid stream, Three-arm or six arm or more structures are within the scope of the invention.

BRIEF DESCRIPTION OF THE DRAWING FIGURES

Some preferred embodiments of fluid injection device according to the invention will now be described, by way of example, with reference to the accompanying drawings, wherein.

DETAILED DESCRIPTION OF THE DRAWING AND PREFERRED EMBODIMENTS

Figure 1:
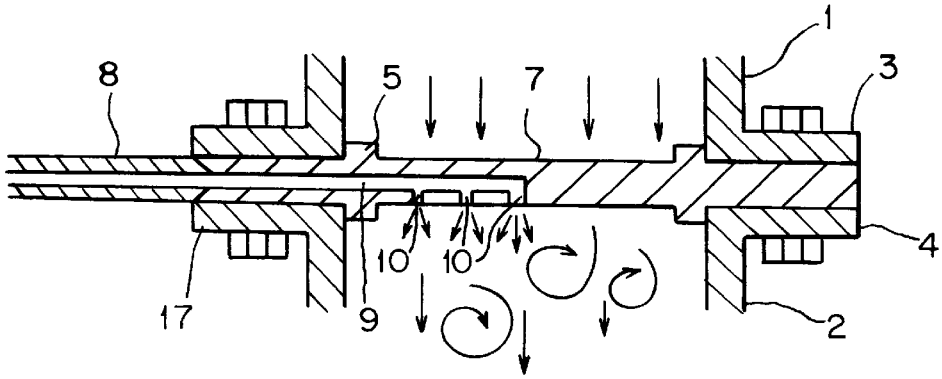
FIG. 1 is a diagrammatic axial cross-sectional view of a pipe line incorporating a fluid injection device according to the invention.

FIG. 1 shows a cross-section of part of a pipe line for liquid and/or gas-flow, such as an oil or gas line from a production site. The line comprises a plurality of sections, such as 1, 2 with respective flanges 3, 4. At a location where it is desired to introduce additives such as conditioning chemicals, the flanges 3, 4 are separated, preferably during construction for the insertion of an injection device 5, according to the invention. Insertion into an existing pipe line by jacking apart the flanges would be possible but much more difficult. The device 5 includes a plate, wheel or disc like member with a central aperture 6 similar and preferably equal to the interior diameter of the pipe line, traversed by a plurality of radial or diametrical members or spokes or cross-bar members 7 (see FIGS. 2 and 4).

One or more branch conduits 8 enter the device 5 to provide a flow of additive fluid and these are connected to passages such as 9, extending into the radial cross-bar members 7, provided with a series of outlet ports 10 opening on the downstream side of the respective cross-bar member 7.

Figure 4:
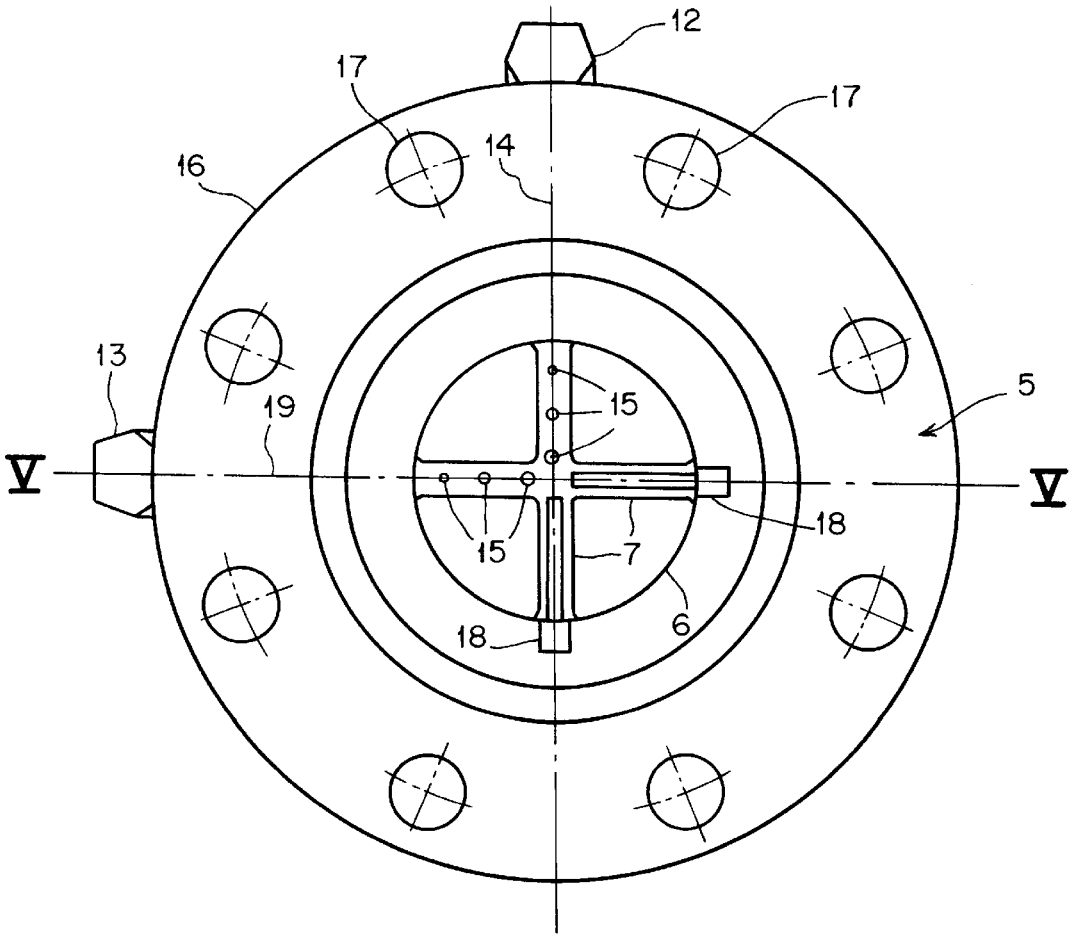
FIG. 4 is a view similar to FIG. 2 of a second embodiment of fluid a injection device according to the invention.

The flanges 3, 4 are secured by means of nut and bolt connections passing through corresponding apertures in a flange of the device 5 (FIGS. 1 and 4). In an alternative embodiment, no ports are provided, but one or more sensors such as temperature sensors are provided to monitor the condition of the fluid. Such a further embodiment may be located upstream of the device 5.

Figure 2:
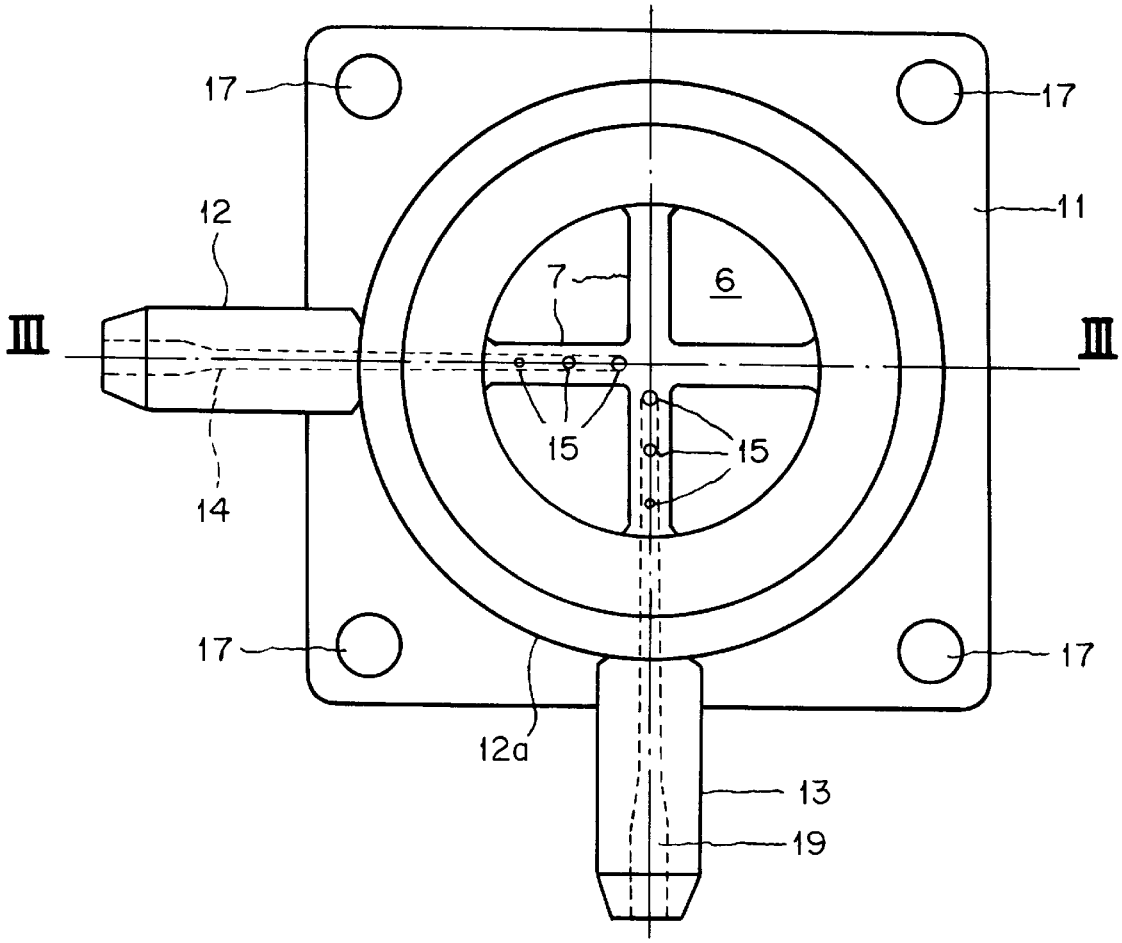
FIG. 2 is a plan view of one embodiment of fluid injection device of the invention viewed from below with respect to FIG. 1.
Figure 3:
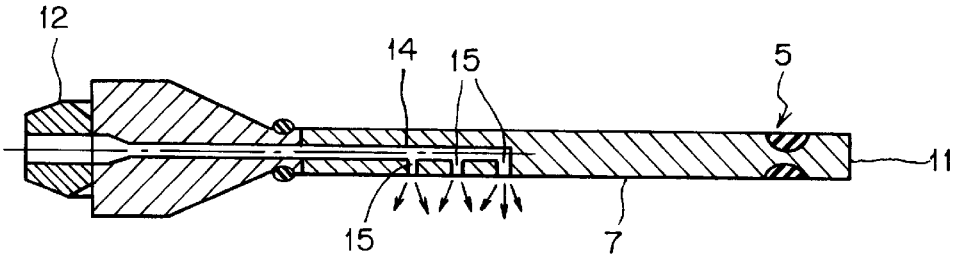
FIG. 3 is a diametrical cross-section of the device of FIG. 2 on line III—III of FIG. 2.

FIGS. 2 and 3 show a plan and a sectional view of an injection device 5 according to the invention for introduction simultaneously of two different additives. The device 5 consists of a substantially square shaped member, with a rim 11, with a channel 12*a* for a rubber or plastics sealing ring, and a central aperture 6 is traversed by four radial cross-bar members 7, forming two diametrical members in a cruciform array. Spigots 12, 13 connect to respective branch lines, and have interior passages or ducts 14, 19, respectively, which extend along respective ones of the radial cross-bar members 7. As shown, each interior passage of duct 14, 19 has three outlets 15, of increasing size away from the rim and towards the center of the pipe. The passages or ducts 14, 19 within the cross-bar members 7 extend radially inward of the aperture 6 of the plate member and towards, but not beyond, the central axis of the injection apparatus as shown in FIGS. 1–5. Also, as seen in FIGS. 1–5, the passages or ducts 14, 19 each have a terminal portion positioned adjacent the central axis of the injection apparatus. The corners of the square member have bolt holes 17, for bolting between pipe flanges 3, 4 as in FIG. 1. The ratio of diameters may be 1:2:4 giving flow area ratios of 1:4:16, but actual sizes and ratios will need to be established by trial, and will depend on the flow properties of the additive, as well as other factors.

Figure 5:
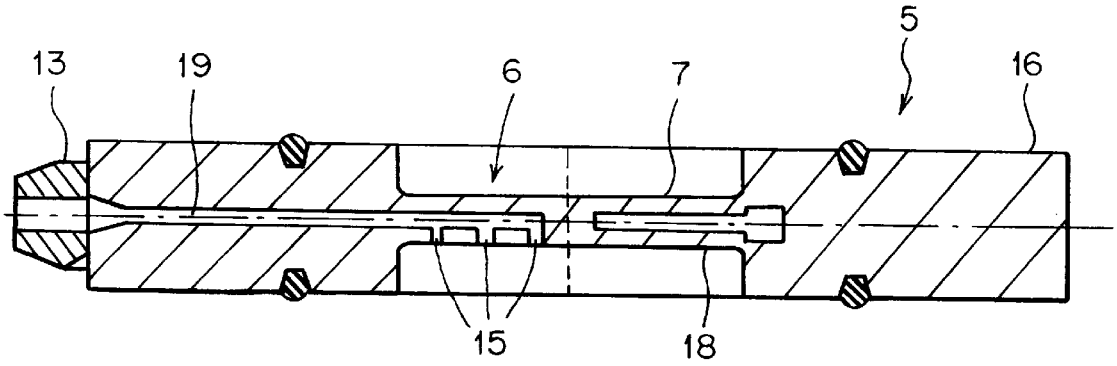
FIG. 5 is a view similar to FIG. 3 of the device of FIG. 4 on line V—V of FIG. 4.

FIGS. 4 and 5 show similar views of a different embodiment of injection device according to the invention, which is closer to that shown in FIG. 1. This differs from that shown in FIGS. 2 and 3 in that it is provided with a substantial flange 16, provided with bolt holes 17, for connection in the manner suggested in FIG. 1. Otherwise, parts corresponding to parts shown in FIGS. 2 and 3 have the same reference numerals and operate in the same way. Monitoring devices such as temperature etc. sensors 18 may be provided in the device, in the arms of the radial members 7 not provided with passages 14.

Figure 6:
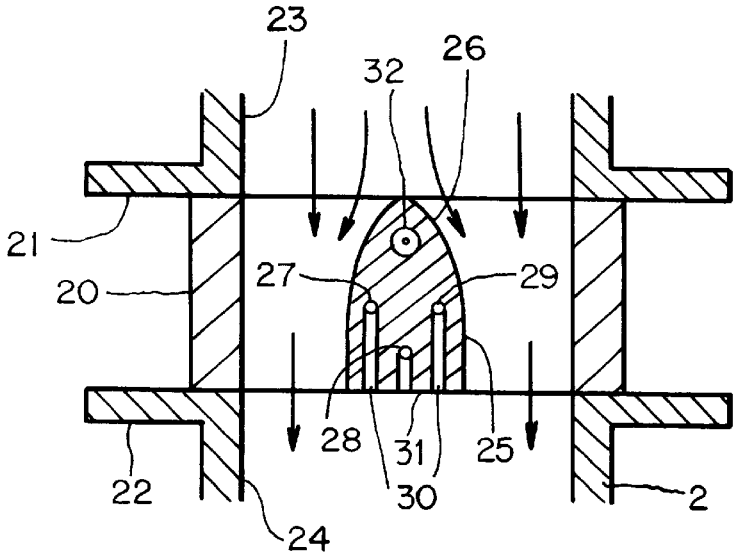
FIG. 6 is a diagrammatic cross-sectional view of a third embodiment of a fluid injection device according to the invention, comprising a cylindrical body, which is located between end flanges of adjacent pipe sections.
Figure 7:
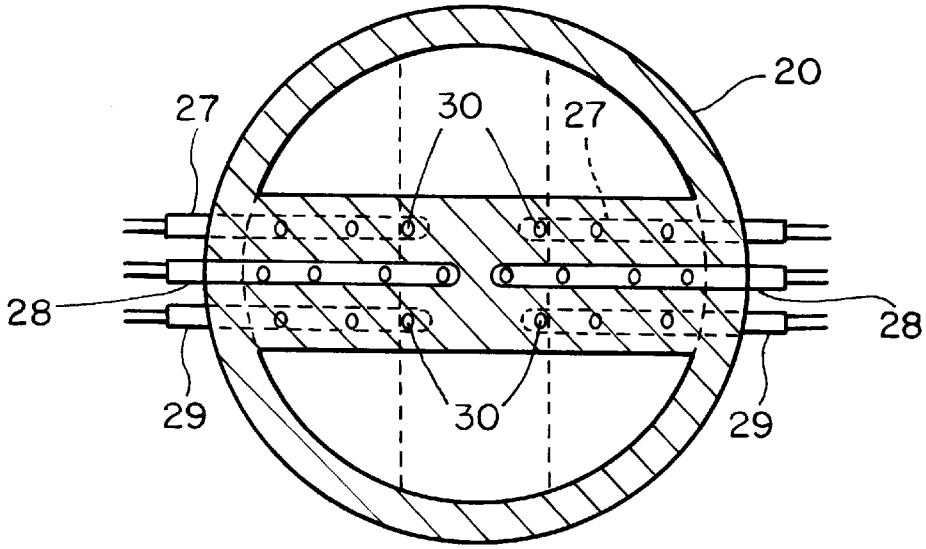
FIG. 7 is a diagrammatic cross-sectional view of the embodiment of the invention illustrated in FIG. 6; and, FIG. 8 is a prospective view of a fourth embodiment of a fluid injection device according to the invention, comprising a machined metal block, of substantially cylindrical profile, having four passages providing a through conduit for fluid.

FIGS. 6 and 7 illustrate diagrammatically a further embodiment of apparatus according to the invention, which comprises a cylindrical body 20, which is located between end flanges 21, 22 of adjacent pipe sections 23 and 24. The body 20 has a bore which matches that of the pipe sections 23, 24. A diametrical bar 25 extends across the bore of the body 20, and has a streamlined upstream profile at 26. A plurality of bores 27, 28, 29 extend into the bar 25 and ports 30 extend to the downstream face 31 of the bar 25. The bores can be used to introduce metered dosages or steady flows of up to three different conditioning additives to the fluid stream. The same additives are fed from each side to ensure even distribution through the stream.

A monitoring device 32 such as a temperature sensor may be provided in the bar towards the apex of the streamlined profile 26 on the upstream side.

Figure 8:
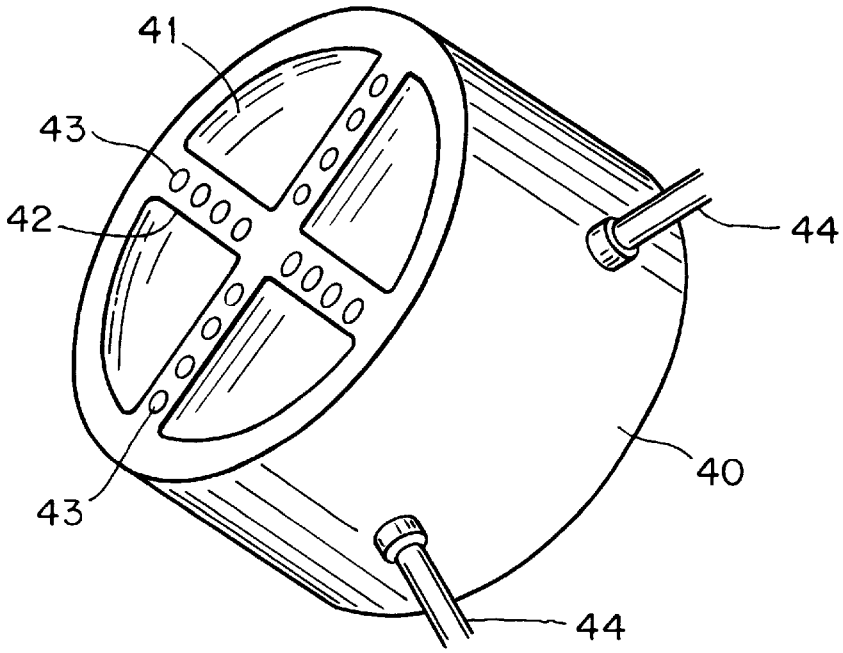

A further embodiment of the device is shown in FIG. 8 comprising a machined metal block 40, of generally cylindrical profile, provided with four passages 41 providing a through conduit for fluid, in a clover-leafed pattern, separated by thick walls 42, forming a cruciform array. Ports 43 are connected to conduits in the walls 42 (not shown) connected to inlet pipes 44 for additives. The block 40 is viewed with the downstream face exposed to show the ports 43.

The injection device operates, for example in a high velocity flow such as an oil or gas pipe line, to inject additives, such as conditioning chemicals, so as to provide an effective mixing of the additives with the main flow. The radial members create turbulence in the previously laminar pipe line flow, into which the additive is introduced, which aids the mixing process. The injection device may be used in a variety of applications, for example for mixing reagents, catalysts, tracer materials, and other minor or trace additives in chemical, food, pharmaceutical and other industries.

The device may be used in conjunction with a static mixing device, being located upstream thereof, or without any additional mixing apparatus. It may alternatively be used in conjunction with other devices such as mixing chambers, venturis, or active mixing devices.

For use in food or pharmaceutical industries, the device may be made to be easily removable for cleaning and sterilisation or autoclaving.

The device may be used in a range of applications including undersea well heads where the additive chemicals can be introduced using an ambilical cord, or in deoxygenation columns for treatment of seawater used as a cooling medium (to reduce the corrosive capacity of the seawater), or in gas or oil production platforms where the judicious additions of chemicals is essential to efficient operation.

What is claimed is:

1. An injection apparatus for introducing one or more additives to a gaseous or liquid stream in a pipeline, comprising:

a plate member securable between end flanges of adjacent sections of pipe in a pipeline and having an aperture with a diameter being substantially equal to a diameter of the pipeline, said plate member having an inlet for introducing an additive to a gaseous or liquid stream; and, an array of one or more cross-bar members extending across the aperture of said plate member with at least one said cross-bar member having a duct leading from the inlet in said plate member, the duct extending radially inwards of the aperture of said plate member, within said cross-bar member, and towards, but not beyond, the central axis of the injection apparatus, wherein the duct has a terminal portion positioned adjacent said axis, the duct further including at least one outlet open from said cross-bar member from a downstream side of said cross-bar member.

2. The injection apparatus according to claim 1, wherein a separate inlet duct is provided for each said cross-bar member, said separate inlet duct being connectable to a respective feed line for each of the additives to be introduced.

3. The injection apparatus according to claim 1, further comprising a plurality of said cross-bar members and wherein each said cross-bar member has a separate, respective radial or diametrical bore for providing, in a cruciform arrangement of said cross-bar members, two diametrical manifolds, one diametrical and two radial manifolds, or four radial manifolds.

4. The injection apparatus according to claim 1, further comprising a sensing device coupled to said apparatus.

5. The injection apparatus according to claim 4, wherein said sensing device includes at least one temperature sensor.

6. The injection apparatus according to claim 4, wherein said sensing device is a thermocouple located in a portion of one said cross-bar member.

7. The injection apparatus according to claim 1, comprising a plurality of said cross-bar members in a cruciform array within the aperture of said plate member, with a duct extending along each arm of said cruciform array.

8. The injection apparatus according to claim 7, which is substantially square in plan.

9. The injection apparatus according to claim 7, which is substantially circular in plan.

10. The injection apparatus according to claim 7, further comprising sensors provided in said plate member.

11. The injection apparatus according to claim 7, further comprising sensors in duct-free portions of said cross-bar members.

12. The injection apparatus according to claim 1, comprising a plurality of said cross-bar members with each of said cross-bar members having one of said ducts with outlets for said ducts increasing in diameter toward said axis.

13. An injection apparatus for introducing one or more additives to a gaseous or liquid stream in a pipeline, comprising:

a plate member securable between end flanges of adjacent sections of pipe in a pipeline and having an aperture with a diameter being substantially equal to a diameter of the pipeline, said plate member having an inlet for introducing an additive to a gaseous or liquid stream; and, an array of cross-bar members extending across the aperture of said plate member with said cross-bar members each having a duct leading from the inlet in said plate member, the duct of each of said cross-bar members extending radially inwards of the aperture of said plate member, within each respective cross-bar member of said cross-bar members, and towards, but not beyond, the central axis of the injection apparatus, wherein the duct has a terminal portion positioned adjacent said axis, the duct of each said respective cross-bar member further including at least one outlet open from said respective cross-bar member from a downstream side of said respective cross-bar member.

14. The injection apparatus according to claim 13, wherein a separate inlet duct is provided for each said respective cross-bar member, said separate inlet duct being connectable to a respective feed line for each of the additives to be introduced.

15. The injection apparatus according to claim 13, wherein each said respective cross-bar member has a separate, respective radial or diametrical bore for providing, in a cruciform arrangement of said cross-bar members, two diametrical manifolds, one diametrical and two radial manifolds, or four radial manifolds.

16. The injection apparatus according to claim 13, further comprising a sensing device coupled to said apparatus.

17. The injection apparatus according to claim 16, wherein said sensing device includes at least one temperature sensor.

18. The injection apparatus according to claim 16, wherein said sensing device is a thermocouple located in a portion of one said cross-bar members.

* * * * *